US010837156B1

(12) United States Patent
Olsen

(10) Patent No.: US 10,837,156 B1
(45) Date of Patent: Nov. 17, 2020

(54) AUTOMATED POST HOLE DIGGER

(71) Applicant: Dishon Olsen, Battle Ground, WA (US)

(72) Inventor: Dishon Olsen, Battle Ground, WA (US)

( * ) Notice: Subject to any disclaimer, the term of this patent is extended or adjusted under 35 U.S.C. 154(b) by 0 days.

(21) Appl. No.: 16/413,083

(22) Filed: May 15, 2019

(51) Int. Cl.
*E21B 11/00* (2006.01)
*E02F 3/02* (2006.01)
*E21B 7/02* (2006.01)

(52) U.S. Cl.
CPC ..... *E02F 3/02* (2013.01); *E21B 7/028* (2013.01); *E21B 11/005* (2013.01)

(58) Field of Classification Search
CPC ..... E05F 3/02
See application file for complete search history.

(56) References Cited

U.S. PATENT DOCUMENTS 2,598,288 A * 5/1952 Navarre ..... E21B 11/005 294/50.8
3,291,231 A 12/1966 Kammer
3,638,741 A 2/1972 Zizak
4,884,638 A 12/1989 Hoffman
D311,853 S 11/1990 Stormsgaard
5,133,269 A 7/1992 Charneski
6,981,911 B2 1/2006 Martina
2010/0259056 A1 10/2010 Freeman

* cited by examiner

*Primary Examiner* — Kristyn A Hall

(57) ABSTRACT

An automated post hole digger for efficient, assisted hole digging includes a base plate having a top side separated from a bottom side forming an inner cavity. A pair of jaws is pivotably coupled to the base plate. A bottom end of each of a pair of handles is coupled to the pair of jaws to move the pair of jaws between an open position and a closed position. A hole saw is coupled to the base plate and comprises a motor, a battery pack, a piston coupled to the motor and extending through the bottom side, and a bit head that is selectively engageable with the piston. The piston is driven by the motor and the bit head is configured to break up hard soil, clay, concrete, and other material. A plurality of controls is coupled to the pair of handles to operate the hole saw.

10 Claims, 5 Drawing Sheets

AUTOMATED POST HOLE DIGGER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to post hole diggers and more particularly pertains to a new post hole digger for efficient, assisted hole digging.

BRIEF SUMMARY OF THE INVENTION

An embodiment of the disclosure meets the needs presented above by generally comprising a base plate having a top side separated from a bottom side forming an inner cavity. A pair of jaws is coupled to the base plate. Each of the pair of jaws has a hinge coupled within a proximal end and a distal end extending away from the bottom side of the base plate. The hinge is coupled to the base plate to allow the jaw to pivot such that the pair of jaws has an open position and an alternate closed position in which the distal ends of each jaw touch. The pair of jaws is configured to secure hard soil, clay, rocks, concrete, or a post base. A bottom end of each of a pair of handles is coupled to the proximal end of the pair of jaws. The pair of handles is used to move the pair of jaws between the open position and the closed position with greater leverage. A hole saw is coupled to the base plate and comprises a motor, a battery pack, a piston coupled to the motor and extending through the bottom side, and a bit head that is selectively engageable with the piston. The piston is driven by the motor and the bit head is configured to break up hard soil, clay, concrete, rocks, or a post base. The curvature of the pair of jaws prevents contact with the hole saw in the open position, the closed position, and all intermediate positions therebetween. A plurality of controls is coupled to the pair of handles and is in operational communication with the hole saw.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
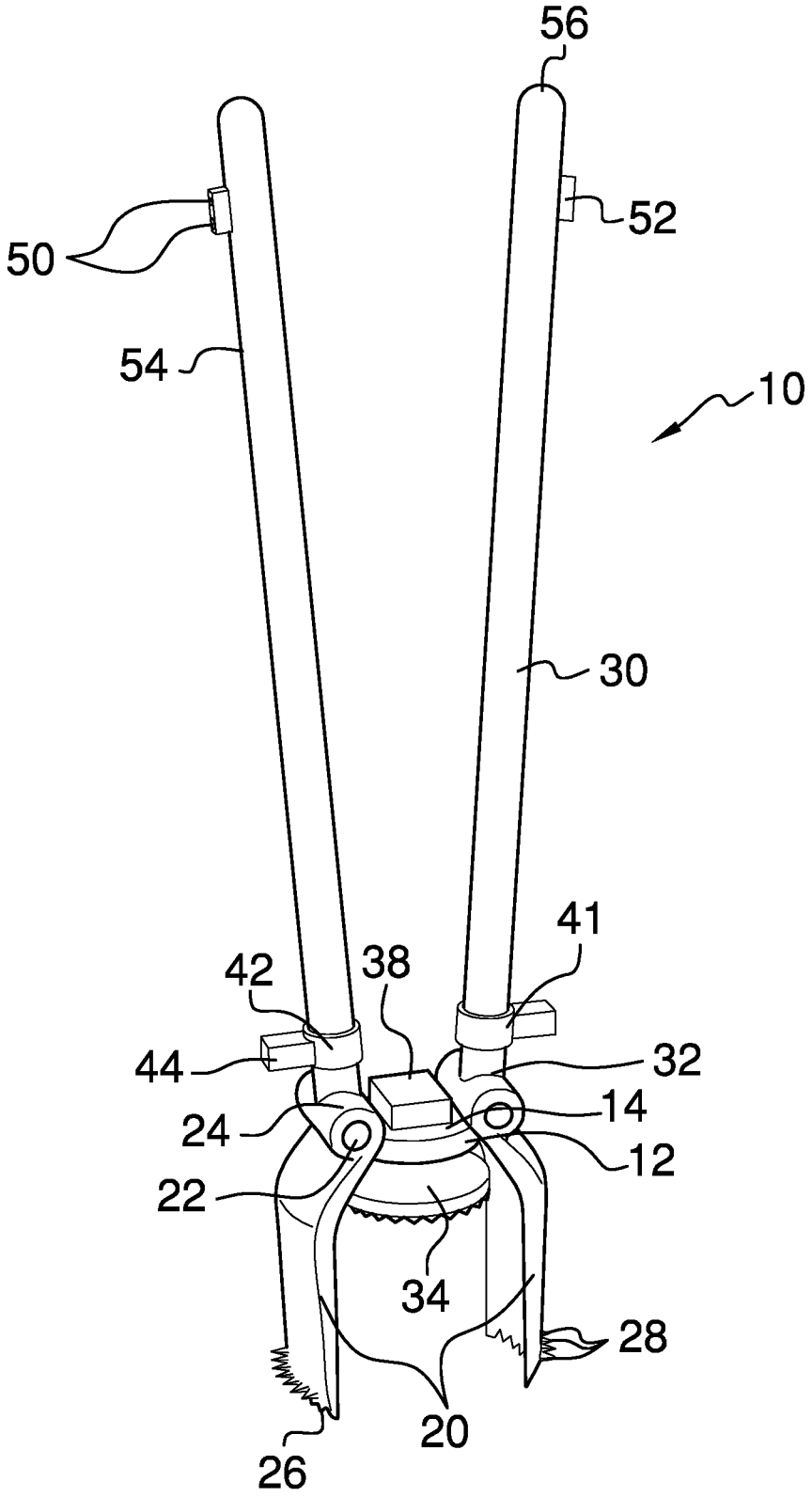
FIG. 1 is an isometric view of an automated post hole digger according to an embodiment of the disclosure.
Figure 2:
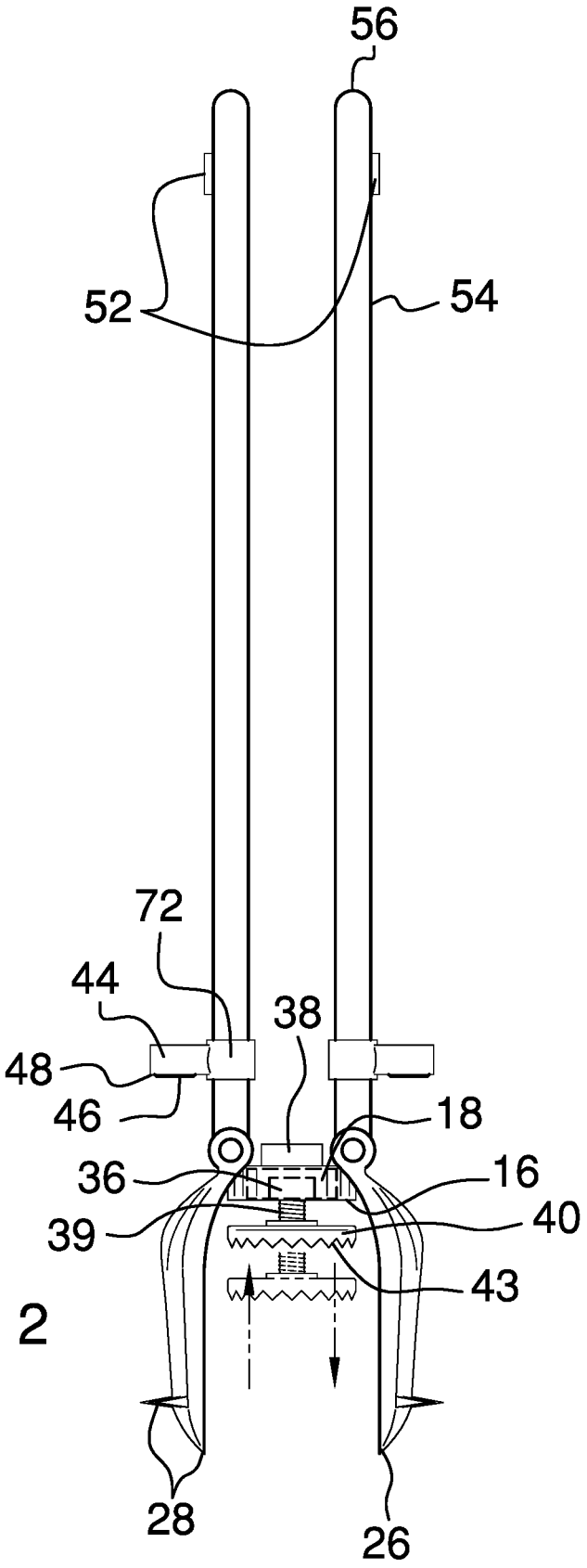
FIG. 2 is a front elevation view of an embodiment of the disclosure.
Figure 3:
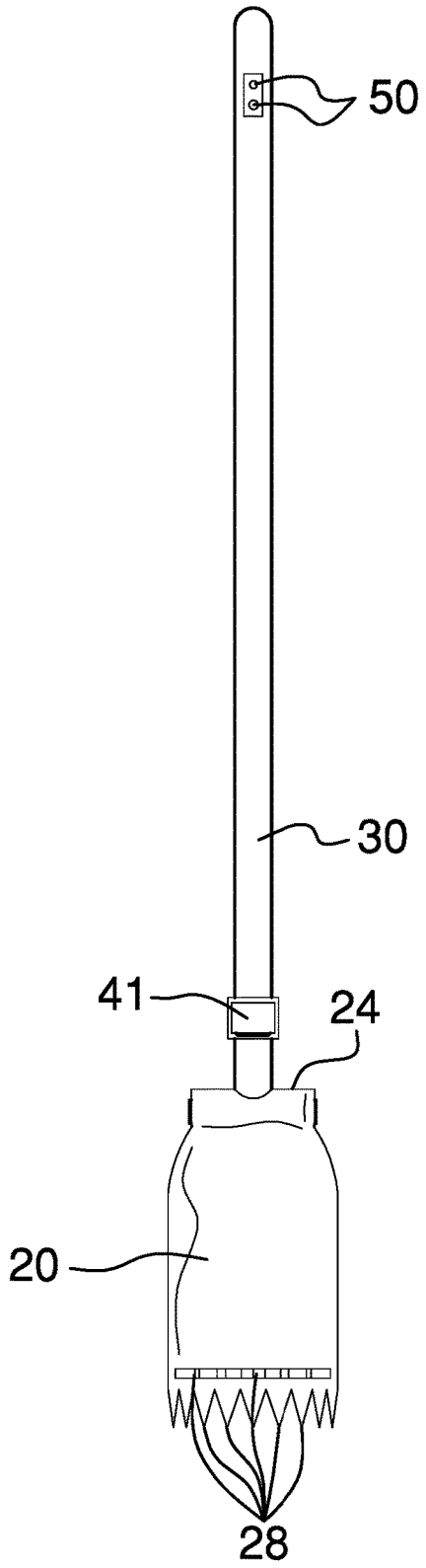
FIG. 3 is a side elevation view of an embodiment of the disclosure.
Figure 4:
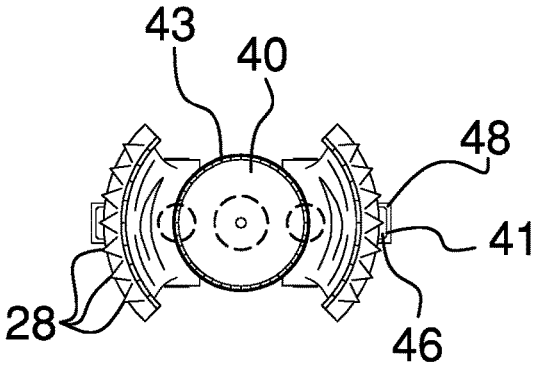
FIG. 4 is a bottom plan view of an embodiment of the disclosure.
Figure 5:
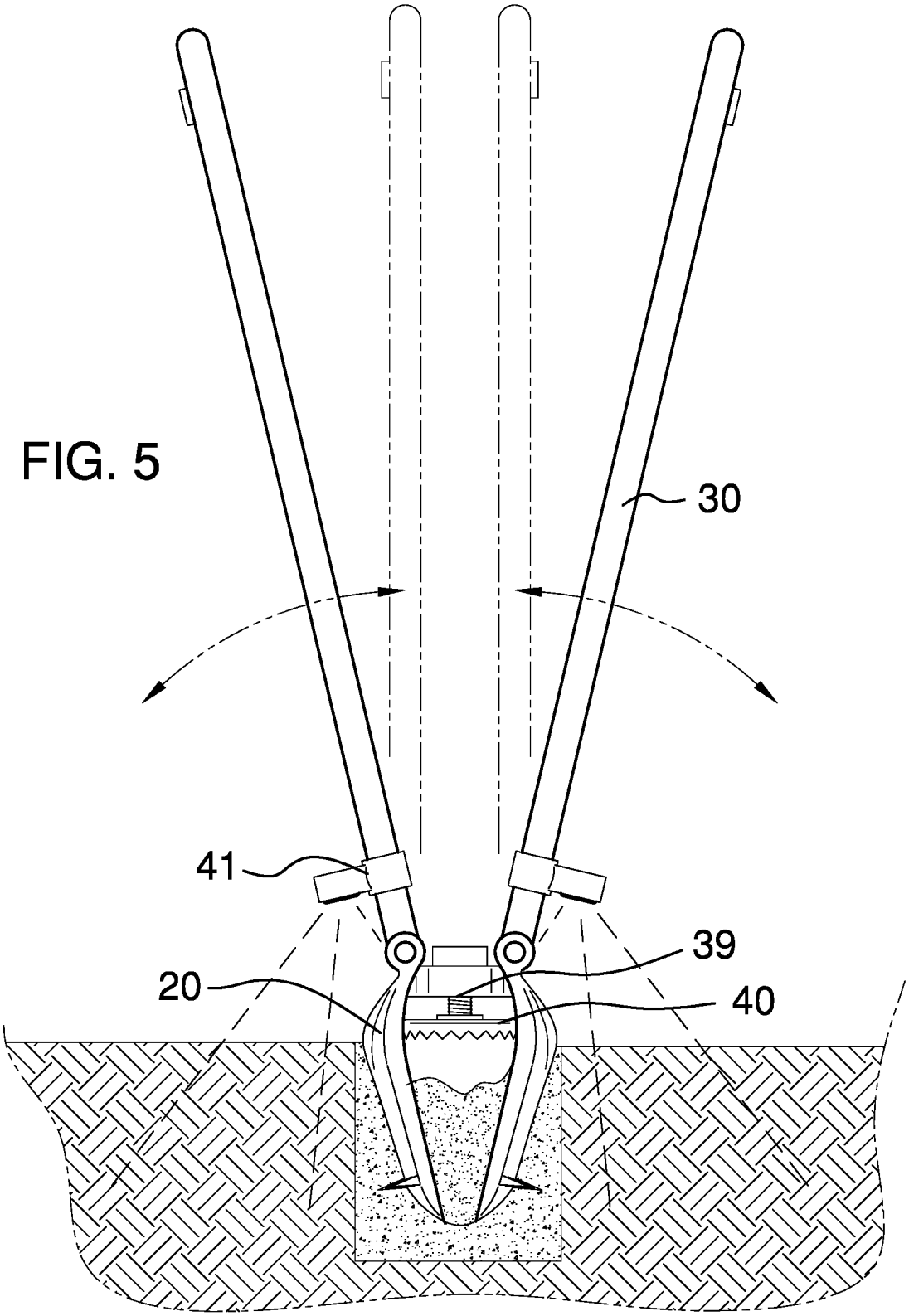
FIG. 5 is an in-use view of an embodiment of the disclosure.
Figure 6:
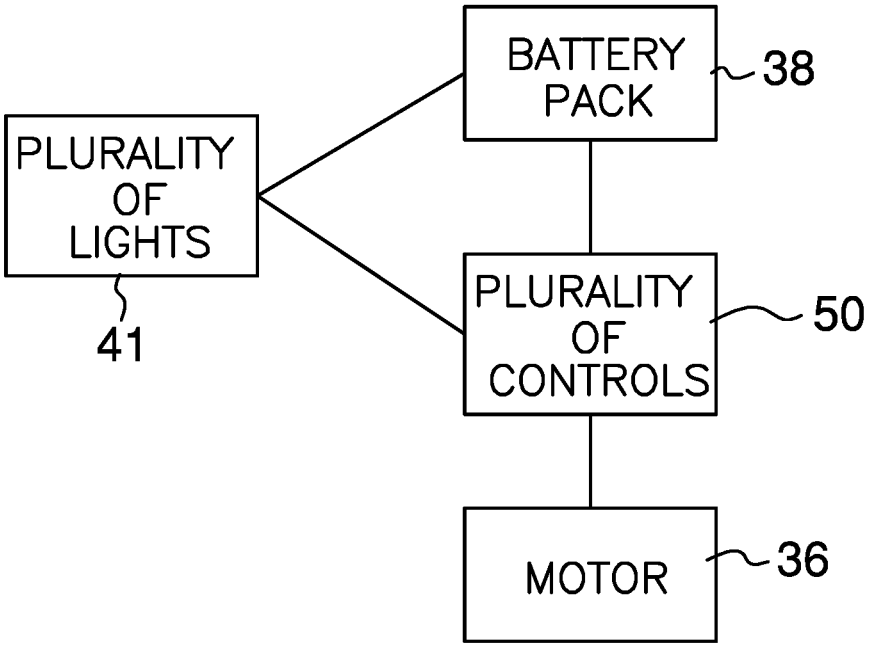
FIG. 6 is a block diagram of an embodiment of the disclosure.

With reference now to the drawings, and in particular to FIGS. 1 through 6 thereof, a new post hole digger embodying the principles and concepts of an embodiment of the disclosure and generally designated by the reference numeral 10 will be described.

As best illustrated in FIGS. 1 through 6, the automated post hole digger 10 generally comprises a base plate 12 having a top side 14 separated from a bottom side 16 forming an inner cavity 18. A pair of jaws 20 is coupled to the base plate 12. Each of the pair of jaws 20 has a hinge 22 coupled within a proximal end 24 and a distal end 26 extends away from the bottom side 16 of the base plate. The hinge 22 is coupled to the base plate 12 to allow the jaw 20 to pivot. The pair of jaws 20 has an open position and an alternate closed position in which the distal ends 26 of each jaw touch. Each of the pair of jaws 20 may have a plurality of teeth 28 extending from the distal end 26. The plurality of teeth 28 extend coplanar and perpendicular with the pair or jaws 20. The pair of jaws 20 is configured to secure hard soil, clay, concrete, rocks, a post base, and other aggregate that may interfere when digging a post hole. A pair of handles 30 is coupled to the pair of jaws 20. A bottom end 32 of each of the pair of handles is coupled to the proximal end 24 of the pair of jaws to move the pair of jaws 20 between the open position and the closed position with greater leverage.

A hole saw 34 is coupled to the base plate 12. The hole saw 34 comprises a motor 36 coupled within the inner cavity 18, a battery pack 38 coupled to the top side 14, a piston 39 coupled to the motor 36 and extending through the bottom side 16, and a bit head 40 having a toothed perimeter 43 and being selectively engageable with the piston 38. The piston 38 is driven by the motor 36 and the bit head 40 is configured to break up hard soil, clay, concrete, rocks, the post base, or other aggregate to then be secured and removed by the pair of jaws 20. The piston 39 may be threaded such that the motor 36 can lower and alternatively raise the piston 39 relative the base plate 12. The bit head 40 may be replaceable or interchangeable to allow for different sizes or purposes depending on the material being dug out. The base plate 12 may be cylindrical to minimize the footprint while the curvature of the pair of jaws 20 prevents contact with the hole saw 34 in the open position, the closed position, and all intermediate positions therebetween.

A pair of lights 41 is coupled to the pair of handles 30. Each of the pair of lights 40 comprises a ring 42, a light housing 44, and a bulb 46. The ring 42 is coupled around the handle 30 proximal the bottom end 32 and the light housing 44 extends from the ring 42. The light housing 44 may be rectangular prismatic with the bulb 46 being coupled within an underside 48 of the light housing to illuminate the pair of jaws 20 and the surrounding area. The pair of lights 41 is in operational communication with the battery pack 38.

A plurality of controls 50 is coupled to the pair of handles 30. The plurality of controls 30 may comprise a pair of rectangular control housings 52 coupled to an outer side 54 of each of the pair of handles proximal a top end 56 to allow operation while gripping the pair of handles 30 for use. The plurality of controls 50 is in operational communication with the hole saw 34 and the pair of lights 40 to rotate the bit head 40 in either direction, to raise and alternatively lower the piston 39, and to operate the pair of lights 41.

In use, the pair of jaws 20 is inserted into the ground and the plurality of controls 50 is used to operate the motor 36 to lower the piston 39 and spin the bit head 40 to break up the material, then to raise the piston 39 and disengage the motor 36. The pair of handles 30 is then squeezed together and lifted to remove material. This process is then repeated until a hole is dug to the desired depth.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automated post hole digger comprising:

a base plate, the base plate having a top side separated from a bottom side forming an inner cavity;

a pair of jaws coupled to the base plate, each of the pair of jaws having a hinge coupled within a proximal end and a distal end extending away from the bottom side of the base plate, the hinge being coupled to the base plate to allow the jaw to pivot, the pair of jaws having an open position and an alternate closed position in which the distal ends of each jaw touch, the pair of jaws being configured to secure hard soil, clay, concrete, rocks, or a post base;

a pair of handles coupled to the pair of jaws, a bottom end of each of the pair of handles being coupled to the proximal end of the pair of jaws, the pair of handles being used to move the pair of jaws between the open position and the closed position with greater leverage;

a hole saw coupled to the base plate, the hole saw comprising a motor, a battery pack, a piston coupled to the motor and extending through the bottom side, and a bit head being selectively engageable with the piston, the piston being driven by the motor and the bit head being configured to break up hard soil, clay, concrete, rocks, or a post base;

wherein the curvature of the pair of jaws prevents contact with the hole saw in the open position, the closed position, and all intermediate positions therebetween; and a plurality of controls coupled to the pair of handles, the plurality of controls being in operational communication with the hole saw.

2. The automated post hole digger of claim 1 further comprising each of the pair of jaws having a plurality of teeth extending from the distal end, the plurality of teeth being coplanar and perpendicular with the pair or jaws.

3. The automated post hole digger of claim 1 further comprising a pair of lights coupled to the pair of handles, the pair of lights being in operational communication with the battery pack and the plurality of controls.

4. The automated post hole digger of claim 3 further comprising each of the pair of lights comprising a ring, a light housing, and a bulb, the ring being coupled around the handle proximal the bottom end and the light housing extending from the ring, the light housing being rectangular prismatic, the bulb being coupled within an underside of the light housing.

5. The automated post hole digger of claim 1 further comprising the piston being threaded, the motor lowering and alternatively raising the piston via the plurality of controls.

6. The automated post hole digger of claim 1 further comprising the bit head having a toothed perimeter.

7. The automated post hole digger of claim 1 further comprising the base plate being cylindrical.

8. The automated post hole digger of claim 1 further comprising the motor being coupled within the inner cavity and the battery pack being coupled to the top side of base.

9. The automated post hole digger of claim 1 further comprising the plurality of controls comprising a pair of rectangular control housings coupled to an outer side of each of the pair of handles proximal a top end.

10. An automated post hole digger comprising:

a base plate, the base plate being cylindrical and having a top side separated from a bottom side forming an inner cavity;

a pair of jaws coupled to the base plate, each of the pair of jaws having a hinge coupled within a proximal end and a distal end extending away from the bottom side of the base plate, the hinge being coupled to the base plate to allow the jaw to pivot, the pair of jaws having an open position and an alternate closed position in which the distal ends of each jaw touch, each of the pair of jaws having a plurality of teeth extending from the distal end, the plurality of teeth being coplanar and perpendicular with the pair or jaws, the pair of jaws being configured to secure hard soil, clay, concrete, rocks, or a post base;

a pair of handles coupled to the pair of jaws, a bottom end of each of the pair of handles being coupled to the proximal end of the pair of jaws, the pair of handles being used to move the pair of jaws between the open position and the closed position with greater leverage;

a hole saw coupled to the base plate, the hole saw comprising a motor coupled within the inner cavity, a battery pack coupled to the top side, a piston coupled to the motor and extending through the bottom side, and a bit head having a toothed perimeter and being selectively engageable with the piston, the piston being driven by the motor and the bit head being configured to break up hard soil, clay, concrete, rocks, or a post base, the piston being threaded, the motor lowering and alternatively raising the piston;

wherein the curvature of the pair of jaws prevents contact with the hole saw in the open position, the closed position, and all intermediate positions therebetween;

a pair of lights coupled to the pair of handles, each of the pair of lights comprising a ring, a light housing, and a bulb, the ring being coupled around the handle proximal the bottom end and the light housing extending from the ring, the light housing being rectangular prismatic, the bulb being coupled within an underside of the light housing, the pair of lights being in operational communication with the battery pack;

a plurality of controls coupled to the pair of handles, the plurality of controls comprising a pair of rectangular control housings coupled to an outer side of each of the pair of handles proximal a top end, the plurality of controls being in operational communication with the hole saw and the pair of lights to rotate the bit head in either direction, to raise and alternatively lower the piston, and to operate the pair of lights.

* * * * *